US011727842B2

(12) United States Patent
Jung et al.

(10) Patent No.: US 11,727,842 B2
(45) Date of Patent: Aug. 15, 2023

(54) DATA DRIVING DEVICE, DATA PROCESSING DEVICE, AND SYSTEM FOR DRIVING DISPLAY DEVICE

(71) Applicant: SILICON WORKS CO., LTD., Daejeon (KR)

(72) Inventors: Hee Yoon Jung, Daejeon (KR); Jung Min Choi, Daejeon (KR); Jong Min Park, Daejeon (KR)

(73) Assignee: SILICON WORKS CO., LTD., Daejeon (KR)

( * ) Notice: Subject to any disclaimer, the term of this patent is extended or adjusted under 35 U.S.C. 154(b) by 0 days.

(21) Appl. No.: 17/489,626

(22) Filed: Sep. 29, 2021

(65) Prior Publication Data

US 2022/0114937 A1 Apr. 14, 2022

(30) Foreign Application Priority Data

Oct. 14, 2020 (KR) ..... 10-2020-0132846

(51) Int. Cl.
*G09G 3/20* (2006.01)

(52) U.S. Cl.
CPC ..... *G09G 3/20* (2013.01); *G09G 2310/027* (2013.01); *G09G 2310/0291* (2013.01); *G09G 2330/021* (2013.01)

(58) Field of Classification Search
CPC ..... G09G 2310/027; G09G 2310/0291
See application file for complete search history.

(56) References Cited

U.S. PATENT DOCUMENTS

| | | | | |
|---|---|---|---|---|
| 5,294,803 | A * | 3/1994 | Pahr | G11B 5/5508 |
| 7,800,573 | B2 | 9/2010 | Woo et al. | |
| 9,754,549 | B2 | 9/2017 | Kwon et al. | |
| 9,773,468 | B2 | 9/2017 | Woo et al. | |
| 2006/0214898 | A1 | 9/2006 | Woo et al. | |
| 2008/0174462 | A1 * | 7/2008 | Tsuchi | G09G 3/3614 327/108 |
| 2014/0253532 | A1 | 9/2014 | Woo et al. | |
| 2016/0098967 | A1 | 4/2016 | Kwon et al. | |
| 2017/0287429 | A1 * | 10/2017 | Kong | G09G 3/3685 |
| 2022/0114937 | A1 * | 4/2022 | Jung | G09G 3/20 |

FOREIGN PATENT DOCUMENTS

| | | | |
|---|---|---|---|
| KR | 10-0688538 | B1 | 3/2007 |
| KR | 10-1660977 | B1 | 9/2016 |
| KR | 10-2018-0121328 | A | 11/2018 |
| KR | 10-2009166 | B1 | 10/2019 |
| KR | 10-2211124 | B1 | 2/2021 |

* cited by examiner

*Primary Examiner* — Van N Chow
(74) *Attorney, Agent, or Firm* — Rothwell, Figg, Ernst & Manbeck, P.C.

(57) ABSTRACT

The present disclosure relates to a data-driving device and a system for driving a display device and, more specifically, a data-driving device and a system for reducing power consumption of a display device by reducing a static current of the data-driving device.

12 Claims, 12 Drawing Sheets

*FIG. 5*

| | Ch.1 | Ch.2 | Ch.3 | Ch.4 | Ch.5 | Ch.6 | ··· | Ch.N | share |
|---|---|---|---|---|---|---|---|---|---|
| 1 | G[255] | G[255] | G[255] | G[255] | G[255] | G[255] | ··· | G[255] | X |
| 2 | G[255] | G[255] | G[255] | G[255] | G[255] | G[255] | ··· | G[255] | ○ |
| 3 | G[255] | G[255] | G[255] | G[255] | G[255] | G[255] | ··· | G[255] | ○ |
| ⋮ | ⋮ | ⋮ | ⋮ | ⋮ | ⋮ | ⋮ | ··· | ⋮ | ⋮ |
| H-1 | G[0] | G[0] | G[0] | G[0] | G[0] | G[0] | ··· | G[255] | |
| H | G[255] | G[255] | G[255] | G[255] | G[255] | G[0] | ··· | G[255] | X |
| H+1 | G[255] | G[255] | G[255] | G[255] | G[255] | G[0] | ··· | G[255] | ○ |
| H+2 | G[0] | G[0] | G[0] | G[0] | G[0] | G[0] | ··· | G[255] | X |

*FIG. 6*

| | Ch.1 amp | Ch.2 amp | Ch.3 amp | Ch.4 amp | Ch.5 amp | Ch.6 amp | ... | Ch.N amp |
|---|---|---|---|---|---|---|---|---|
| 1 | active | active | active | active | active | active | ... | active |
| 2 | active | sleep | sleep | sleep | sleep | active | ... | sleep |
| 3 | active | sleep | sleep | sleep | sleep | active | ... | sleep |
| ⋮ | ⋮ | ⋮ | ⋮ | ⋮ | ⋮ | ⋮ | ... | ⋮ |
| H-1 | active | active | active | active | active | active | ... | active |
| H | active | active | active | active | active | active | ... | active |
| H+1 | active | sleep | sleep | sleep | sleep | active | ... | sleep |
| H+2 | active | active | active | active | active | active | ... | active |

DATA DRIVING DEVICE, DATA PROCESSING DEVICE, AND SYSTEM FOR DRIVING DISPLAY DEVICE

CROSS REFERENCE TO RELATED APPLICATION

This application claims priority from Republic of Korea Patent Application No. 10-2020-0132846, filed on Oct. 14, 2020, which is hereby incorporated by reference in its entirety.

BACKGROUND

1. Field of Technology

The present disclosure relates to a data-driving device and a system for driving a display device.

2. Description of the Prior Art

A display device may include a data-processing device called a timing controller, a data-driving device called a source driver, and a panel, and the data-processing device may be designed to provide image data to be displayed on the data-driving device, and control data and a clock in a packet form.

The data-driving device receives image data and provides a data voltage corresponding to the image data, and the panel displays a screen corresponding to the data voltage.

The display device is required to adopt a technology for reducing power consumption in various elements, and active adaptation of a technology for reducing power consumption at levels of the data-processing device and the data-driving device is considered.

SUMMARY OF THE INVENTION

According to the background, an aspect of the present embodiment is to provide a technology for reducing power consumption of a display device by reducing static currents of a data-driving device.

In accordance with an aspect of the present disclosure, a device for driving data is provided. The device comprises: a plurality of channel amplifiers, each arranged in every channel; and a controlling circuit configured, when a piece of data for a horizontal line H (H being a natural number) is identical to a piece of data for a horizontal line H+1 among pieces of image data for a frame and a piece of pixel data of a first channel is identical to a piece of pixel data of a second channel adjacent to the first channel among a plurality of pieces of pixel data for the horizontal line H+1, to control a second channel amplifier, among a first channel amplifier for outputting a data voltage corresponding to the piece of pixel data of the first channel and the second channel amplifier for outputting a data voltage corresponding to the piece of pixel data of the second channel, to be deactivated and to control the first channel and the second channel share the data voltage of the first channel amplifier in an active state during a horizontal driving period for the piece of data of the horizontal line H+1.

In accordance with another aspect of the present disclosure, a system is provided. The system comprises: a data-processing device configured to compare a piece of data for a horizontal line H (H being a natural number) with a piece of data for a horizontal line H+1 among pieces of data of a frame for driving pixels of a panel, when the piece of data of the horizontal line H is identical to the piece of data of the horizontal line H+1, to compare whether a piece of pixel data of a first channel is identical to a piece of pixel data of a second channel adjacent to the first channel among a plurality of pieces of pixel data for the horizontal line H+1, when the piece of pixel data of the first channel is identical to the piece of pixel data of the second channel, to generate amplifier configuration data, and to sequentially transmit the piece of data for the horizontal line H, the amplifier configuration data, and the piece of data for the horizontal line H+1; and a data-driving device comprising a plurality of channel amplifiers and configured to sequentially receive the piece of data of the horizontal line H, the amplifier configuration data, and the piece of data of the horizontal line H+1 from the data-processing device, to deactivate a second channel amplifier, among a first channel amplifier for outputting a data voltage corresponding to the piece of pixel data of the first channel and the second channel amplifier for outputting a data voltage corresponding to the piece of pixel data of the second channel, according to the amplifier configuration data during a horizontal driving period for the piece of data of the horizontal line H+1, and to make the first channel and the second channel share the data voltage of the first channel amplifier in an active state.

The data-driving device may be configured to make the data voltage of the first channel amplifier be shared through a data line connected to an output side of the second channel amplifier.

In accordance with still another aspect of the present disclosure, a data processing device is provided. The data processing device comprises: a receiving circuit configured to receive data for one frame from an external element; a controlling circuit configured to compare a piece of data for a horizontal line H (H being a natural number) with a piece of data for a horizontal line H+1 among data for the one frame, when the piece of data for the horizontal line H is identical to the piece of data for the horizontal line H+1, to compare whether a piece of pixel data of a first channel is identical to a piece of pixel data of a second channel adjacent to the first channel among pieces of data for the horizontal line H+1, and, when the piece of pixel data of the first channel is identical to the piece of pixel data of the second channel, to generate amplifier configuration data including first configuration information in order to activate, among a plurality of channel amplifiers comprised in a data-driving device, a first channel amplifier for outputting a data voltage corresponding to the piece of the pixel data of the first channel, and to deactivate a second channel amplifier for outputting a data voltage corresponding to the piece of pixel data of the second channel; and a transmitting circuit configured to transmit the piece of data for the horizontal line H to the data-driving device and to sequantially transmit the amplifier configuration data and the piece of data for the horizontal line H+1 to the data-driving device.

The amplifier configuration data may further comprise second configuration information in order for the data-driving device to make the first channel and the second channel share the data voltage of the first channel amplifier.

The first configuration information may be a register value stored in a register comprised in the data-driving device.

As described above, according to an the present embodiment, when the data of the horizontal line H is identical to the data of the horizontal line H+1 in frame data and two or more pieces of adjacent pixel data are identical to each other in the data of the horizontal line H and the data of the horizontal line H+1, the data-driving device may selectively deactivate driving of channel amplifiers for the data of the horizontal line H+1 to reduce static currents, thereby reducing power consumption of the display device.

BRIEF DESCRIPTION OF THE DRAWINGS

FIG. 5 illustrates a condition for reducing a static current by the data-driving device according to an embodiment;

FIGS. 6 to 10 illustrate an operation in which the data-driving device selectively deactivates channel amplifiers according to an embodiment.

DETAILED DESCRIPTION OF THE EXEMPLARY EMBODIMENTS

Figure 1:
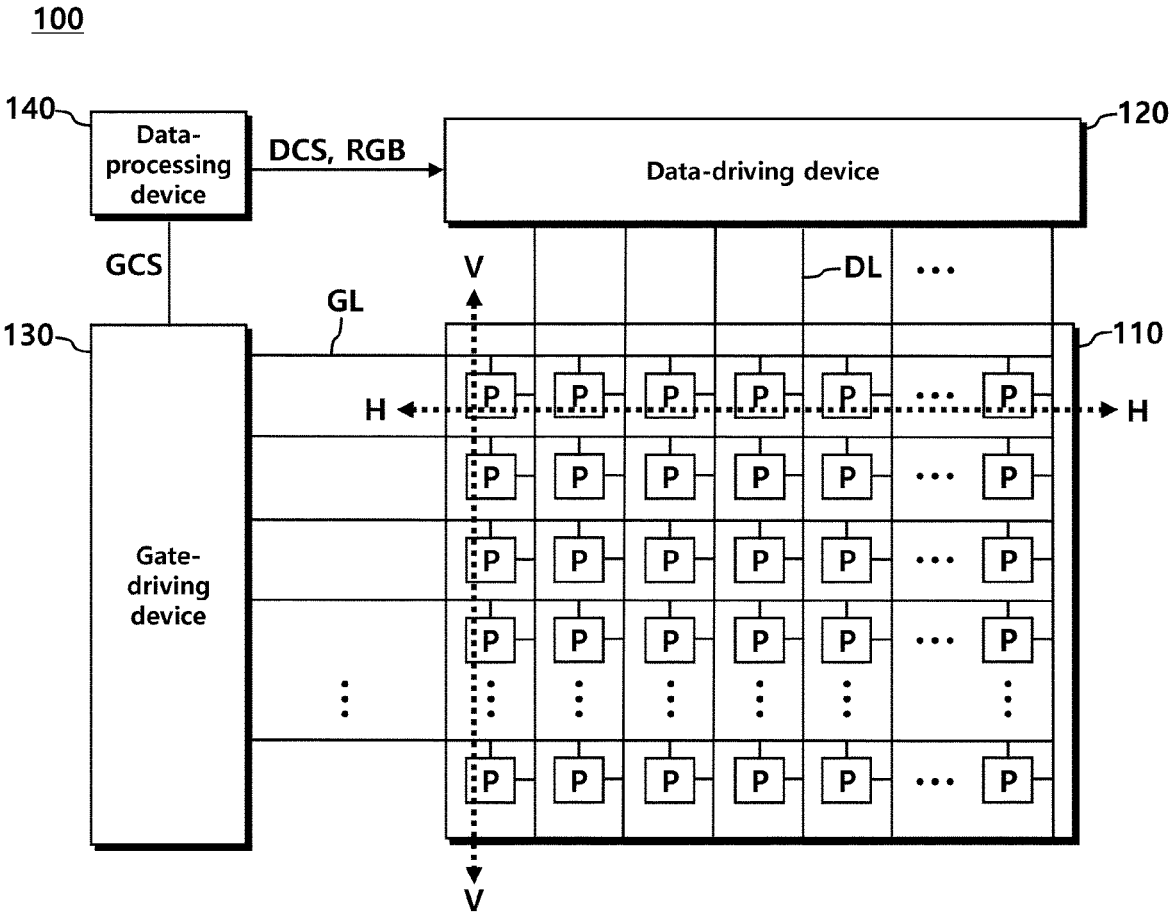
FIG. 1 is a block diagram illustrating a display device according to an embodiment.

FIG. 1 is a block diagram illustrating a display device according to an embodiment.

Referring to FIG. 1, a display device 100 may include a panel 110, a data-driving device 120, a gate-driving device 130, a data-processing device 140, and the like.

A plurality of data lines DL, a plurality of gate lines GL, and a plurality of pixels P may be arranged on the panel 110. The plurality of pixels P may be arranged in a horizontal direction H and a vertical direction V of the panel 110 to be adjacent to each other in a square form. The square form may be similar to a matrix, a set of pixels P arranged in the horizontal direction H may be defined as pixel rows or horizontal lines, and a set of the plurality of pixels P arranged in the vertical direction V may be defined as pixel columns or vertical lines.

The gate-driving device 130 may supply scan signals of a turn-on voltage or a turn-off voltage to the gate lines GL. When the scan signal of the turn-on voltage is supplied to the pixels P, the corresponding pixels P may be connected to the data lines DL. When the scan signal of the turn-off voltage is supplied to the pixels P, the connection between the corresponding pixels P and the data lines DL may be released.

The data-driving device 120 supplies data voltages to the data lines DL. The data voltages supplied to the data lines DL are transferred to the Pixels P connected to the data lines DL according to the scan signal.

The data-processing device 140 may supply a control signal to each of the gate-driving device 130 and the data-driving device 120. The data-processing device 140 may generate a gate control GCS for starting a scan according to timing implemented in each frame and transmits the gate control signal to the gate-driving device 130. The data-processing device 140 may output image data IMG converted from image data input from an external element to fit a data format used by the data-driving device 120 to the data-driving device 120. Further, the data-driving device 140 may transmit a data control signal DCS for controlling the data-driving device 120 to supply the data voltage to each pixel P according to each timing.

Figure 2:
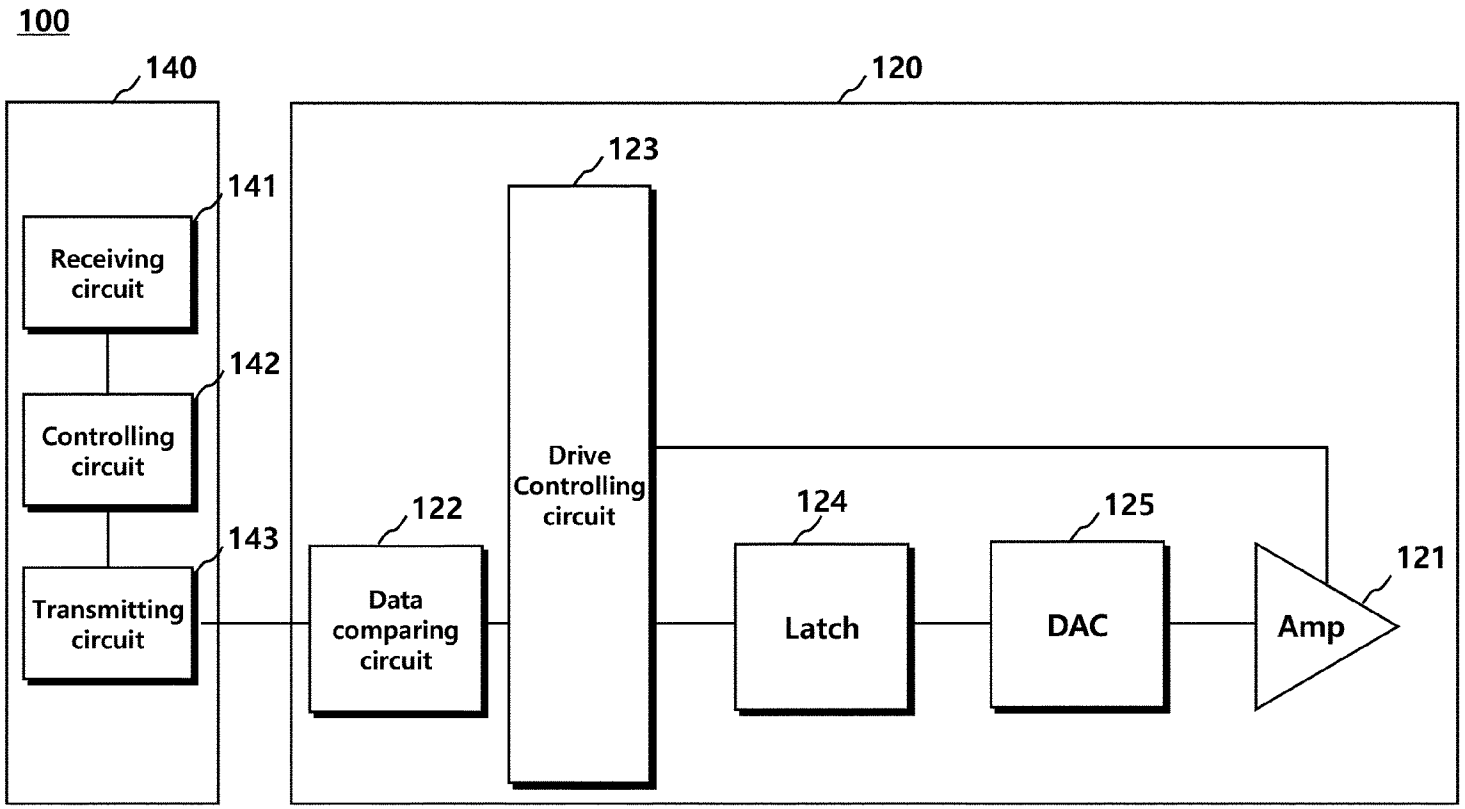
FIG. 2 is a block diagram illustrating a data-driving device and a data-processing device according to an embodiment.

FIG. 2 is a block diagram illustrating the data-driving device and the data-processing device according to an embodiment.

Referring to FIG. 2, the data-processing device 140 may include a receiving circuit 141, a controlling circuit 142, and a transmitting circuit 143.

The receiving circuit 141 may receive image data from an external element and transfer the same to the controlling circuit 142.

The controlling circuit 142 may process the image data received from the receiving circuit 141 to have a format which can be processed by the data-driving device 120 and transmit the processed image data to the data-driving device 120 through the transmitting circuit 143.

The image data may include a plurality of pieces of frame data, and the receiving circuit 141 may sequentially receive the plurality of pieces of frame data and transfer the same to the controlling circuit 142. The controlling circuit 142 may sequentially process the plurality of pieces of frame data and transmit the same to the data-driving device 120.

The transmitting circuit 143 may sequentially transmit the plurality of pieces of frame data to the data-driving device 120 under the control of the controlling circuit 142. One piece of frame data may include a plurality of pieces of horizontal line data, and one piece of horizontal line data may include a plurality of pieces of pixel data.

The number of plurality of pieces of horizontal line data may be the same as the number of horizontal lines arranged on the panel 110, and the number of pieces of plurality of pixel data may be the same as the number of vertical lines arranged on the panel 110.

Meanwhile, the data-driving device 120 may include a channel amplifying unit 121, a data comparing circuit 122, a drive controlling circuit 123, a latch unit 124, and a digital analog converter 125.

The channel amplifying unit 121 may amplify a data voltage converted by the digital analog converter 125 described below and apply the same to the data lines DL, so as to drive pixels P.

Figure 3:
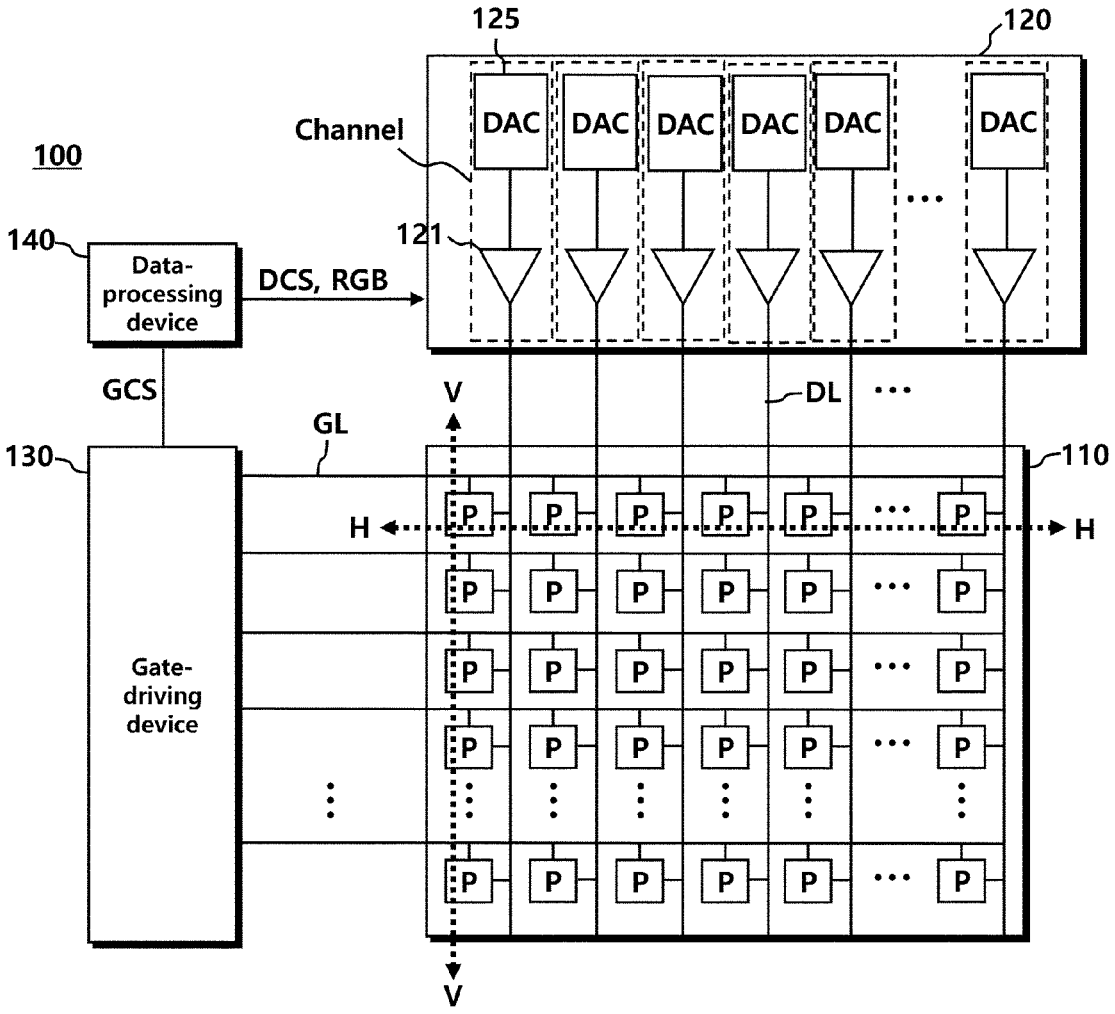
FIGS. 3 and 4 illustrate channel amplifiers of the data-driving device according to an embodiment.

The channel amplifying unit 121 may include a plurality of channel amplifiers 121-1, 121-2, 121-3 . . . , each of which is arranged in every channel as illustrated in FIG. 3, and each channel amplifier may be an amplifier having no polarity or having a polarity (positive polarity or negative polarity).

Figure 4:
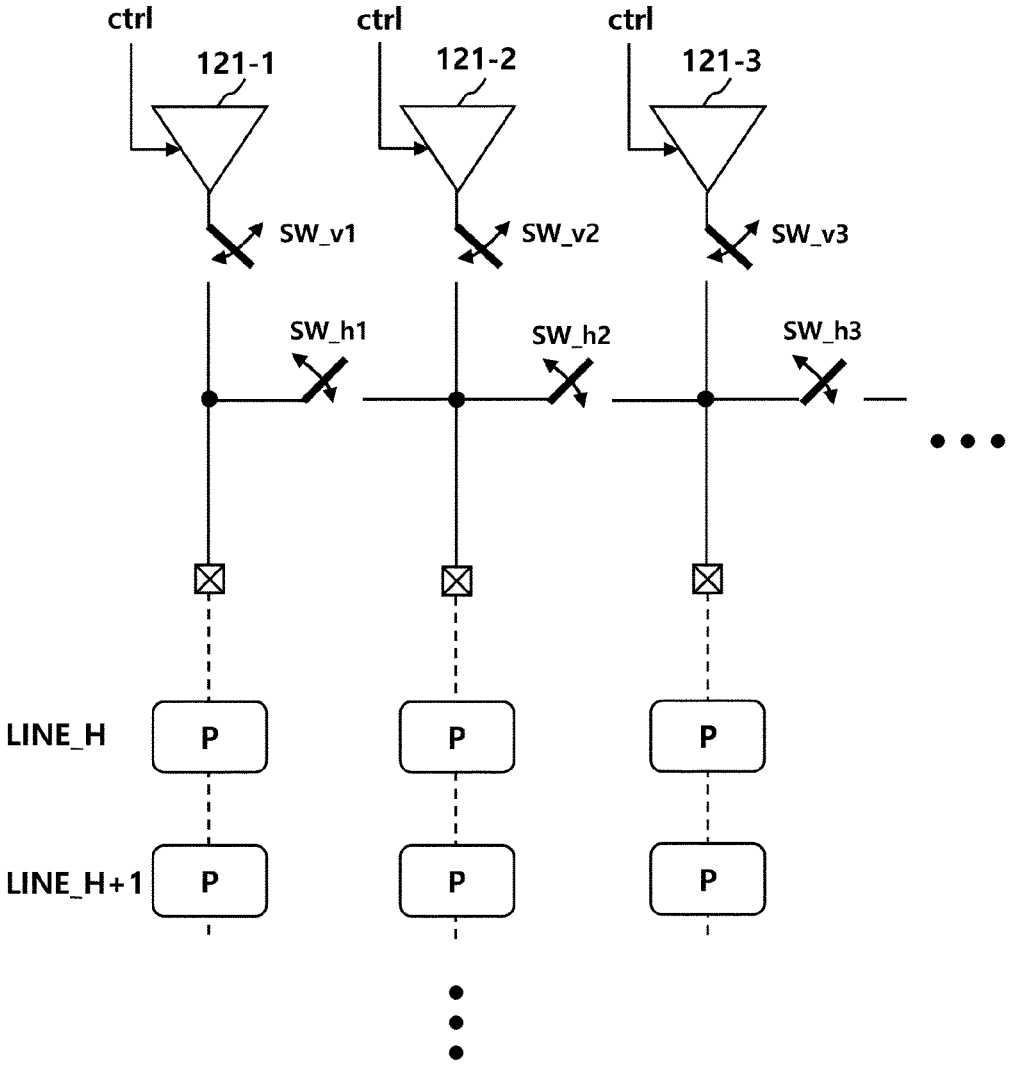

In an embodiment, longitudinal switches SW_v1, SW_v2, SW_v3 . . . for selectively connecting the data lines DL and the plurality of channel amplifiers 121-1, 121-2, 121-3 . . . may be arranged on the output side of the plurality of channel amplifiers 121-1, 121-2, 121-3 . . . , and transverse switches SW_h1, SW_h2, SW_h3 . . . for selectively connecting adjacent data lines DL may be arranged between adjacent data lines DL, as illustrated in FIG. 4. The longitudinal switches and the transverse switches may be shorted or opened by the control of the drive controlling circuit 123 described below. The plurality of channel amplifiers 121-1, 121-2, 121-3 . . . may be activated or deactivated by the control ctrl of the drive controlling circuit 123.

In general, with respect to one piece of frame data, the pixels P of the panel 110 may be sequentially driven in units of horizontal lines, and the plurality of channel amplifiers 121-1, 121-2, 121-3 . . . may consume power while outputting and maintaining the data voltage until the horizontal lines of the panel 110 are all driven.

When two or more pieces of horizontal line data for driving two or more successive horizontal lines are the same, data voltages having the same voltage value are supplied to the two or more successive horizontal lines. In other words, when two or more pieces of successive horizontal line data are the same, magnitudes of the data voltages are not changed in every two or more successive horizontal lines. However, at this time, the plurality of channel amplifiers 121-1, 121-2, 121-3 . . . are continuously activated to maintain the data voltage, and thus a static current due to the same increases. The static current may mean a current consumed by the plurality of channel amplifiers 121-1, 121-2, 121-3 . . . to maintain the constant data voltage.

In an embodiment, the static current may be reduced through the following configuration.

First, the data comparing circuit 122 of the data-driving device 120 may sequentially receive data of a horizontal line H (H being a natural number) included in one piece of frame data and data of a horizontal line H+1 from the data-processing device 140 and compare whether the data of the horizontal line H is the same as the data of the horizontal line H+1. The data of the horizontal line H may be horizontal line data of the horizontal line H to be currently driven, and the data of the horizontal line H+1 may be horizontal line data of the horizontal line H+1 to be driven after the horizontal line H.

For example, when the horizontal line H is a first horizontal line, the data of the horizontal line H may be first horizontal line data, the horizontal line H+1 may be a second horizontal line, and the data of the horizontal line H+1 may be second horizontal line.

After comparing whether the data of the horizontal line H is the same as the data of the horizontal line H+1, the data comparing circuit 122 may compare whether pieces of pixel data of adjacent channels are the same as each other in a plurality of pieces of pixel data included in the data of the horizontal line H or the data of the horizontal line H+1.

For example, after comparing whether data H of the horizontal line (H) is the same as data (H+1) of the horizontal line H+1 in the dotted part among a plurality of pieces of horizontal line data illustrated in FIG. 5, the data comparing circuit 122 may compare whether pieces of pixel data of adjacent channels are the same as each other by comparing whether pixel data of Ch.1 is the same as pixel data of Ch.2 and comparing whether pixel data of Ch.2 is the same as pixel data of Ch.3 in the data (H) of the horizontal line H or the data (H+1) of the horizontal line H+1.

When the plurality of channel amplifiers have polarities, the data comparing circuit 122 may compare pieces of pixel data of odd-numbered channels and compare pieces of pixel data of even-numbered channels.

The data comparing circuit 122 may be configured to group a plurality of channels as a predetermined number of channel blocks and compare a plurality of pieces of pixel data for each channel block. For example, when five channels are configured to be grouped as one channel block, the data comparing circuit 122 may compare whether pieces of pixel data of channel block units are the same as each other by comparing pixel data of Ch.1 to pixel data of Ch.5 are the same each other and compare whether pixel data of Ch.6 to pixel data of Ch.10 are the same as each other.

The data comparing circuit 122 may compare whether all of a plurality of pieces of pixel data, that is, all of pixel data of Ch.1 to pixel data of Ch.N are the same as each other.

When the data of the horizontal line H is the same as the data of the horizontal line H+1, the data comparing circuit 122 may compare two or more pieces of adjacent pixel data in a plurality of pieces of pixel data included in the data of the horizontal line H or the data of the horizontal line H+1. When the data of the horizontal line H is different from the data of the horizontal line H+1, the data comparing circuit 122 may omit comparison of pixel data of adjacent channels.

The drive controlling circuit 123 may control the latch unit 124, the digital analog converter 125, and the plurality of channel amplifiers 121-1, 121-2, 121-3 . . . . The drive controlling circuit 123 may control the longitudinal switches SW_v1, SW_v2, SW_v3 . . . and the transverse switches SW_h1, SW_h2, SW_h3 . . . .

The drive controlling circuit 123 may transfer one piece of frame data of the received image data to the latch unit 124 through the data comparing circuit 122.

Meanwhile, according to an embodiment, when the data of the horizontal line H is the same as the data of the horizontal H+1 in one piece of frame data and when pieces of pixel data of adjacent channels are the same as each other in a plurality of pieces of pixel data included in the data of the horizontal line H or the data of the horizontal line H+1 on the basis of the result of comparison by the data comparing circuit 122, the driving-controlling circuit 123 may realize the following configuration.

First, the drive controlling circuit 123 may activate all of the plurality of channel amplifiers 121-1, 121-2, 121-3 . . . and control the plurality of channel amplifiers 121-1, 121-2, 121-3 . . . to output data voltages for a plurality of pieces of pixel data during a horizontal driving period for the data of the horizontal line H.

Further, the drive controlling circuit 123 may perform control to deactivate one or more channel amplifiers among two or more channel amplifiers for outputting data voltages corresponding to pixel data of adjacent channels and to make the relevant two or more channels share data voltages of channel amplifiers in the active state among the two or more channel amplifiers during a horizontal driving period for the data of the horizontal line H+1.

For example, when channels of the data-driving device 120 are Ch.1 to Ch.N as illustrated in FIG. 5, horizontal line data for horizontal lines of the panel 110 are first line data to (H+2)th line data, and data of the horizontal line H is H line data, the drive controlling circuit 123 may identify that the H line data is the same as H+1 line data corresponding to the data of the horizontal line H+1 on the basis of the result of comparison by the data comparing circuit 122. In other words, the drive controlling circuit 123 may identify that a plurality of pieces of pixel data included in the H line data are the same as a plurality of pieces of pixel data included in the H+1 line data.

Further, the drive controlling circuit 123 may identify that pieces of pixel data (shaded part in FIG. 5) of adjacent channels are identical to each other in the data of the horizontal line H and the data of the horizontal line H+1 on the basis of the result of comparison by the data comparing circuit 122. The pixel data may include a greyscale value, and pieces of pixel data being the same as each other may mean greyscale values being the same as each other.

The H line data may be received after H−1 line data corresponding to data of a horizontal line H−1, and the H−1 line data and the H line data may be different from each other.

Figure 7:
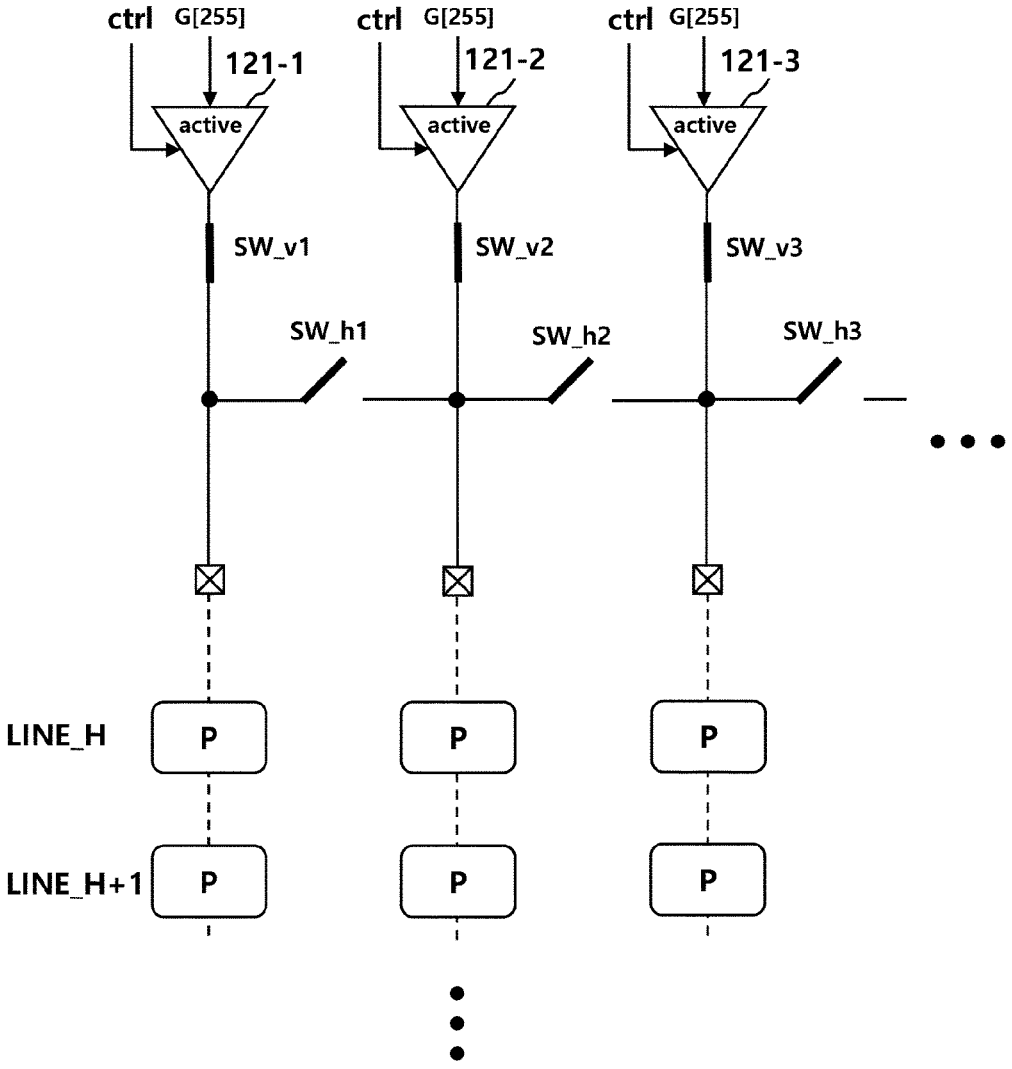

In this case, for the H line data, the drive controlling circuit 123 may activate all of the dotted part in FIG. 6 and the plurality of channel amplifiers 121-1, 121-2, 121-3 . . . for outputting data voltages for a plurality of pieces of pixel data, that is, pixel data of Ch. 1 to Ch.N as illustrated in FIG. 7. A scheme in which the drive controlling circuit 123 activates the plurality of channel amplifiers 121-1, 121-2, 121-3 . . . may be a scheme in which the drive controlling circuit 123 supplies a power voltage (for example, VCC or VDD) and a bias voltage to the plurality of channel amplifiers 121-1, 121-2, 121-3 . . . through a control signal ctrl.

When all of the plurality of channel amplifiers 121-1, 121-2, 121-3 . . . are activated, the drive controlling circuit 123 may short the longitudinal switches SW_v1, SW_v2, SW_v3 . . . arranged on the output side of the plurality of channel amplifiers 121-1, 121-2, 121-3 . . . , and open the transverse switches SW_h1, SW_h2, SW_h3 . . . arranged between adjacent data lines DL.

Accordingly, the data voltage output from each of the plurality of channel amplifiers 121-1, 121-2, 121-3 . . . may be supplied to each of the pixels P included in the horizontal line H (LINE_H in FIG. 7).

Thereafter, the drive controlling circuit 123 may perform control to deactivate one or more channel amplifiers (for example, a second channel amplifier to a fifth channel amplifier of FIG. 6) among two or more channel amplifiers (for example, a first channel amplifier to the fifth channel amplifier of FIG. 6) for outputting the data voltages for pixel data of adjacent channels in the H+1 line data and may control data lines for the one or more channel amplifiers in an inactive state (second channel amplifier to fifth channel amplifier) and a data line for the channel amplifier in an active state (for example, the first channel amplifier of FIG. 6) to share a data voltage of the channel amplifier in an active state. A scheme in which the drive controlling circuit 123 activates the second channel amplifier 121-2 to the fifth channel amplifier may be a scheme in which the drive controlling circuit 123 blocks one or more of the power voltage and the bias voltage supplied to the second channel amplifier 121-2 to the fifth channel amplifier through the control signal ctrl.

Figure 8:
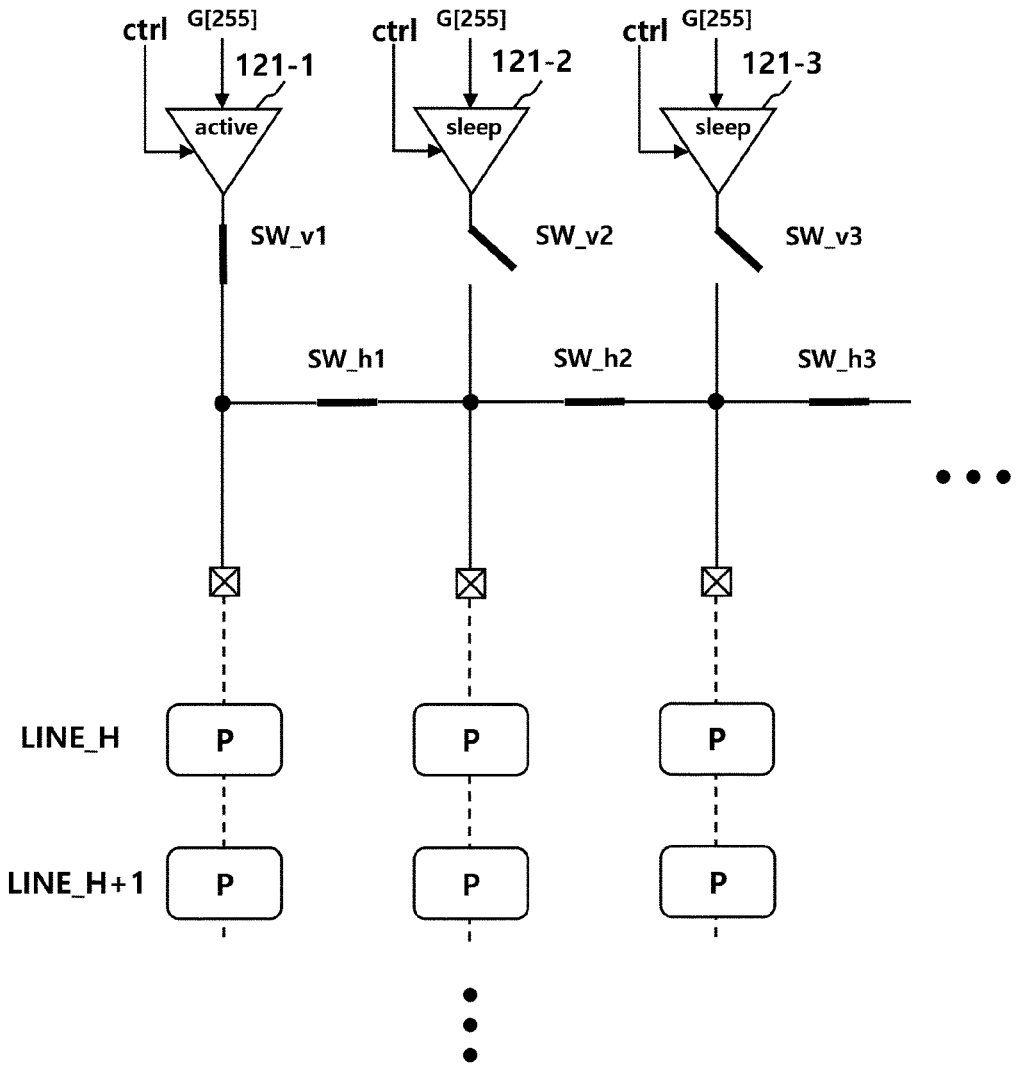

For the sharing of the data voltage of the activated first channel amplifier 121-1 as shown in FIG. 8, the drive controlling circuit 123 may close a longitudinal switch SW_v1 arranged in the output side of the first channel amplifier 121-1, also close transverse switches SW_h1, SW_h2, SW_h3, . . . arranged between data lines for the first channel amplifier 121-1, the second channel amplifier 121-2, the third channel amplifier 121-3, the fourth channel amplifier 121-4, and the fifth channel amplifier, and open longitudinal switches SW_v2, SW_v3 . . . arranged in the output sides of the second channel amplifier 121-2 through the fifth channel amplifier in an inactive state.

Accordingly, the data voltage of the first channel amplifier 121-1 may be supplied to the pixel P on the side of the second channel amplifier 121-2 to the pixel P on the side of the fifth channel amplifier in the H_1 horizontal line (LINE_H+1 of FIG. 8) driven through the H+1 line data.

Meanwhile, when horizontal line data (H+2 line data) after the H+1 line data corresponding to the data of the horizontal line H+1 is different from the data of the horizontal line H+1 in one piece of frame data, the drive controlling circuit 123 may activate again one or more channel amplifiers (second channel amplifier to fifth channel amplifier) during a horizontal driving period for the H+2 line data. Accordingly, all of the plurality of channel amplifiers 121-1, 121-2, 121-3 . . . may be activated during the horizontal driving period for the H+2 line data.

In an embodiment, when the data comparing circuit 122 compares a plurality of pieces of pixel data for each channel block, the drive controlling circuit 123 may also control the channel amplifiers for each channel block.

For example, when the H line data is identical to the H+1 line data and pixel data of the first channel Ch.1 to pixel data of the fifth channel Ch.5 corresponding to one channel block are the same as each other, the drive controlling circuit 123 may maintain the active state of the first channel amplifier and deactivate the second channel amplifier to the fifth channel amplifier during the horizontal driving period for the H+1 line data.

The drive controlling circuit 123 may control the longitudinal switches arranged on the side of the first channel amplifier to the side of the fifth channel amplifier and the transverse switches so that the data lines for the second channel amplifier through the fifth channel amplifier in an inactive state share the data voltage of the first channel amplifier.

In other words, the data voltage of the first channel amplifier is supplied to the pixels P on the sides of the second channel amplifier to the fifth channel amplifier.

The latch unit 124 sequentially latch one piece of frame data and supplies the same to the digital analog converter 125. The latch unit 124 may include a plurality of latches.

The digital analog converter 125 may convert pixel data included in one piece of frame data into an analog signal, for example, a data voltage, and supply the analog signal to the channel amplifying unit 121.

The digital analog converter 125 may be arranged in every channel as illustrated in FIG. 3.

As described above, in an embodiment, when the data of the horizontal line H is the same as the data of the horizontal line H+1 and pieces of pixel data of adjacent channels are the same as each other in the data of the horizontal line H and the data of the horizontal line H+1, the data-driving device 120 may selectively deactivate one or more channel amplifiers among two or more adjacent channel amplifiers and make data voltages of the remaining channel amplifiers, selectively activated among the two or more adjacent channel amplifiers, be shared, thereby reducing static currents by the number of deactivated channel amplifiers.

Figure 9:
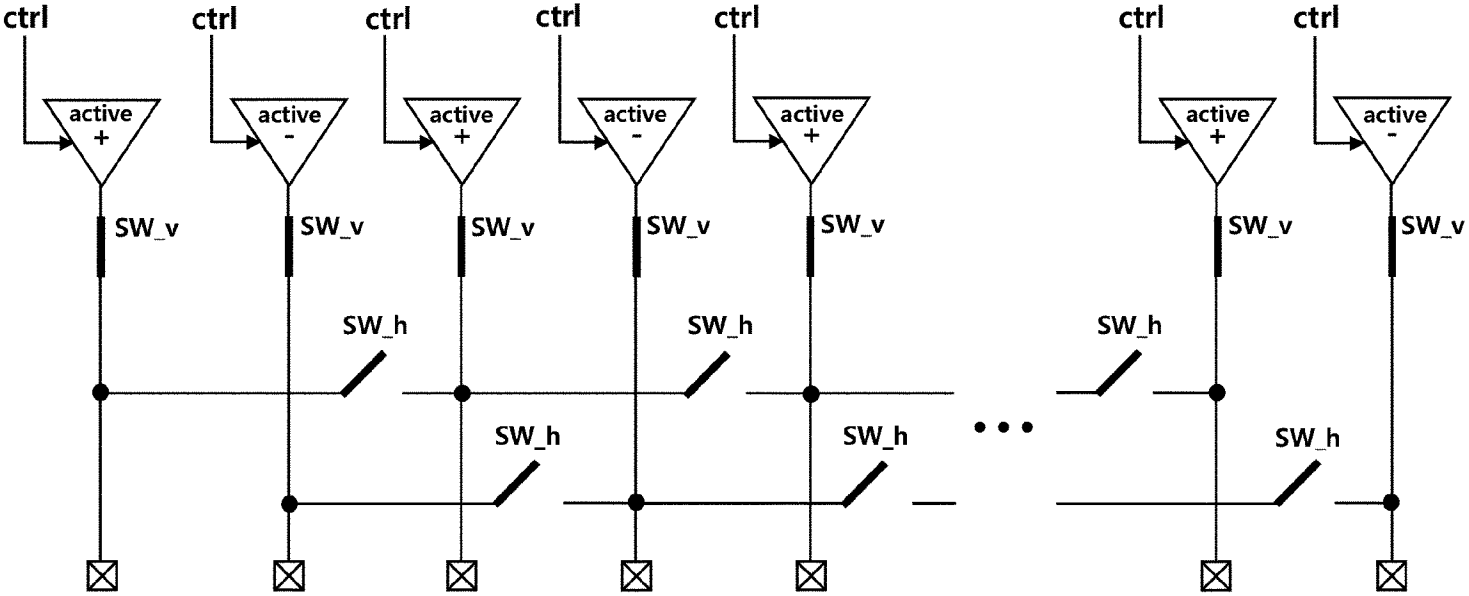
Figure 10:
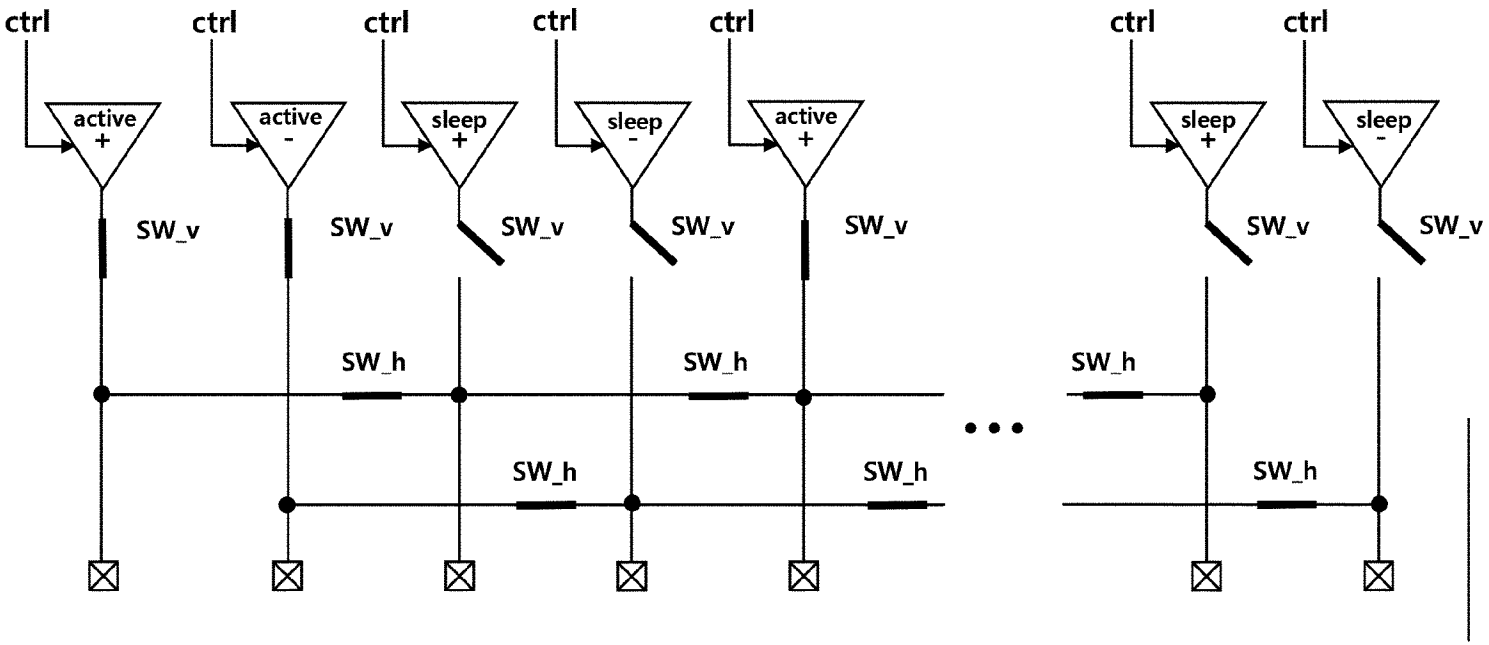

Meanwhile, although FIGS. 7 and 8 illustrate that the plurality of channel amplifiers 121-1, 121-2, 121-3 . . . have no polarity (for example, pixels are organic light emitting diodes), an embodiment is not limited thereto and half of the plurality of channel amplifiers 121-1, 121-2, 121-3 . . . may be positive polarity channel amplifiers and the other half may be negative polarity channel amplifiers as illustrated in FIGS. 9 and 10.

In this case, for the data of the horizontal line H, the drive controlling circuit 123 may activate all of the positive polarity channel amplifiers and the negative polarity channel amplifiers for outputting data voltages for a plurality of pieces of pixel data as illustrated in FIG. 9. The drive controlling circuit 123 may short the longitudinal switches arranged on the output sides of the positive polarity channel amplifiers and the negative polarity channel amplifiers and open all of the transverse switches between adjacent positive polarity data lines and the transverse switches between adjacent negative polarity data lines.

Further, as illustrated in FIG. 10, for the data of the horizontal line H+1, the drive controlling circuit 123 may perform control to deactivate one or more positive polarity channel amplifiers and one or more negative polarity channel amplifiers adjacent to the one or more positive polarity channel amplifiers as illustrated in FIG. 10 and may control data voltages of the activated positive polarity channel amplifiers and negative polarity channel amplifiers to be shared. For the sharing of the data voltages of the activated positive polarity channel amplifiers and negative polarity channel amplifiers, the drive controlling circuit 123 may close the longitudinal switches arranged in the output sides of the positive polarity channel amplifiers and negative polarity channel amplifiers in an active state, the transverse switches between data lines for adjacent positive polarity channel amplifiers, and the transverse switches between data lines for adjacent negative polarity channel amplifiers, and may open the longitudinal switches arranged in the output sides of the one or more deactivated positive polarity channel amplifiers and negative polarity channel amplifiers.

As described above, the data-driving device 120 may compare the data of the horizontal line H with the data of the horizontal line H+1 to selectively deactivate the channel amplifiers in an embodiment.

Hereinafter, the configuration in which the data-processing device 140 compares the data of the horizontal line H with the data of the horizontal line H+1 and the data-driving device 210 selectively deactivates the channel amplifiers is described.

Figure 11:
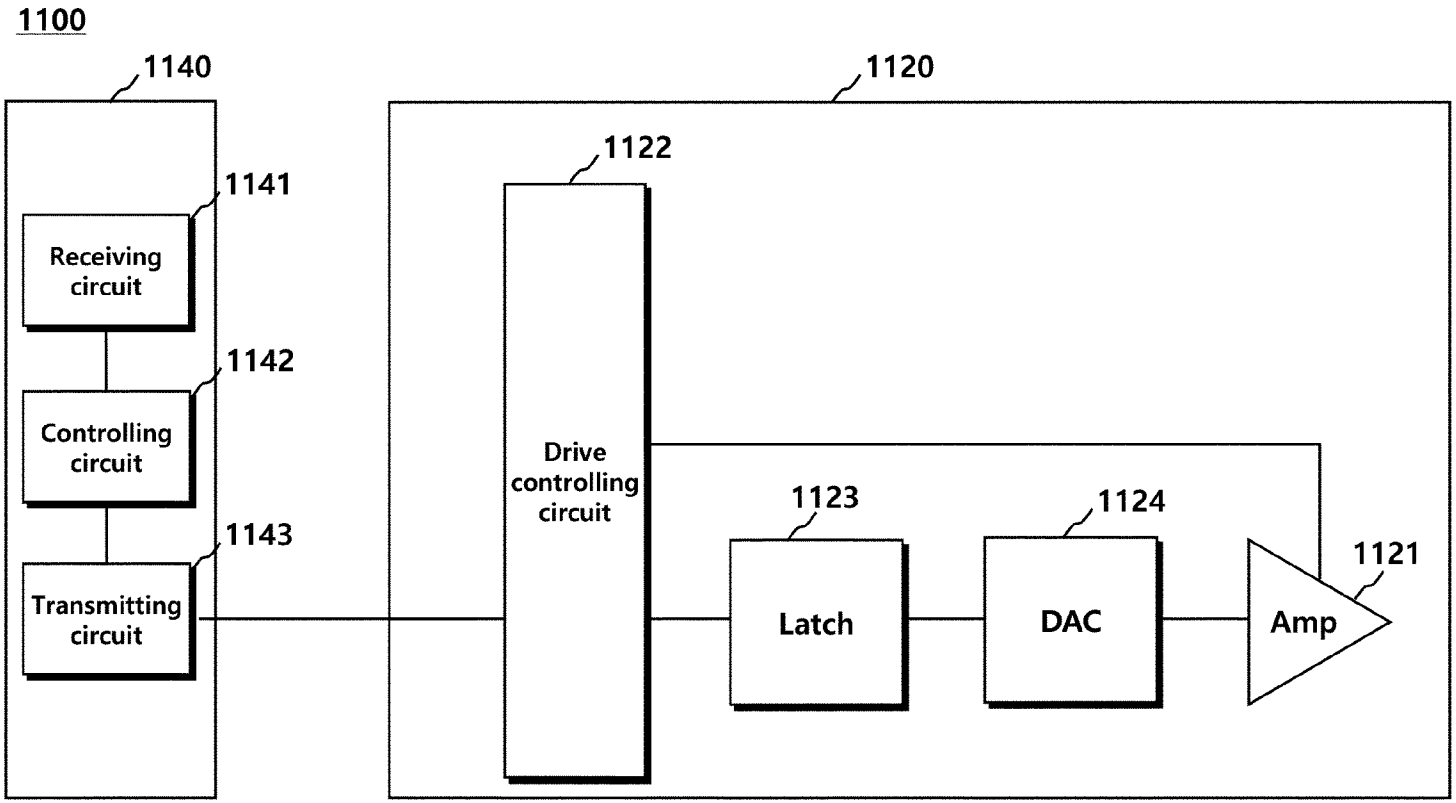
FIG. 11 is a block diagram illustrating the data-driving device and the data-processing device according to another embodiment.

FIG. 11 is a block diagram illustrating the data-driving device and the data-processing device according to another embodiment.

According to another embodiment, in a display device 1100, a data-processing device 1140 may include a receiving circuit 1141, a controlling circuit 1142, and a transmitting circuit 1143, and a data-driving device 1120 may include a channel amplifying unit 1121, a drive controlling circuit 1122, a latch unit 1123, and a digital analog converter 1124. The channel amplifying unit 1121 may include a plurality of channel amplifiers, each of which is arranged in every channel.

In another embodiment, the controlling circuit 1142 of the data-processing device 1140 may compare data of the horizontal line H and data of the horizontal line H+1 in one piece of frame data. The controlling circuit 1142 may receive one piece of frame data from an external element through the receiving circuit 1141.

When a plurality of pieces of pixel data included in the data of the horizontal line H are identical to a plurality of pieces of pixel data included in the data of the horizontal line H+1 on the basis of the result of comparison between the data of horizontal line H and the data of the horizontal line H+1, the controlling circuit 1142 may identify whether pieces of pixel data of adjacent channels are the same as each other in the data of the horizontal line H or the data of the horizontal line H+1.

When pieces of the pixel data of the adjacent channels are identical to each other in the horizontal line H or in the horizontal line H+1, the controlling circuit 1142 may identify locations of two or more channel amplifiers for outputting data voltages for pixel data of adjacent channels among a plurality of channel amplifiers corresponding to the channel amplifying unit 1121.

The controlling circuit 1142 may generate amplifier configuration data according to which one or more channel amplifiers among the two or more channel amplifiers are deactivated and data voltages of the remaining channel amplifiers in the active state, among the two or more channel amplifiers, are shared. The amplifier configuration data may include configuration information for deactivating only one or more channel amplifiers among the two or more channel amplifiers and may be implemented by register values.

Thereafter, the controlling circuit 1142 may sequentially transmit the data of the horizontal line H, the amplifier configuration data, and the data of the horizontal line H+1 to the data-driving device 1120 through the transmitting circuit 1143. When transmitting the amplifier configuration data to the data-driving device 1120, the controlling circuit 1142 may also transmit configuration data for other elements of the data-driving device 1120.

The drive controlling circuit 1122 of the data-driving device 1120 may sequentially receive the data of the horizontal line H, the amplifier configuration data, and the data of the horizontal line H+1 from the data-processing device 1140.

The drive controlling circuit 1122 may perform control to activate all of a plurality of channel amplifiers during the horizontal driving period for the data of the horizontal line H, to deactivate one or more channel amplifiers among two or more channel amplifiers according to the amplifier configuration data during the horizontal driving period for the data of the horizontal line H+1, and to make data voltages of channel amplifiers in the active state among the two or more channel amplifiers be shared.

Figure 12:
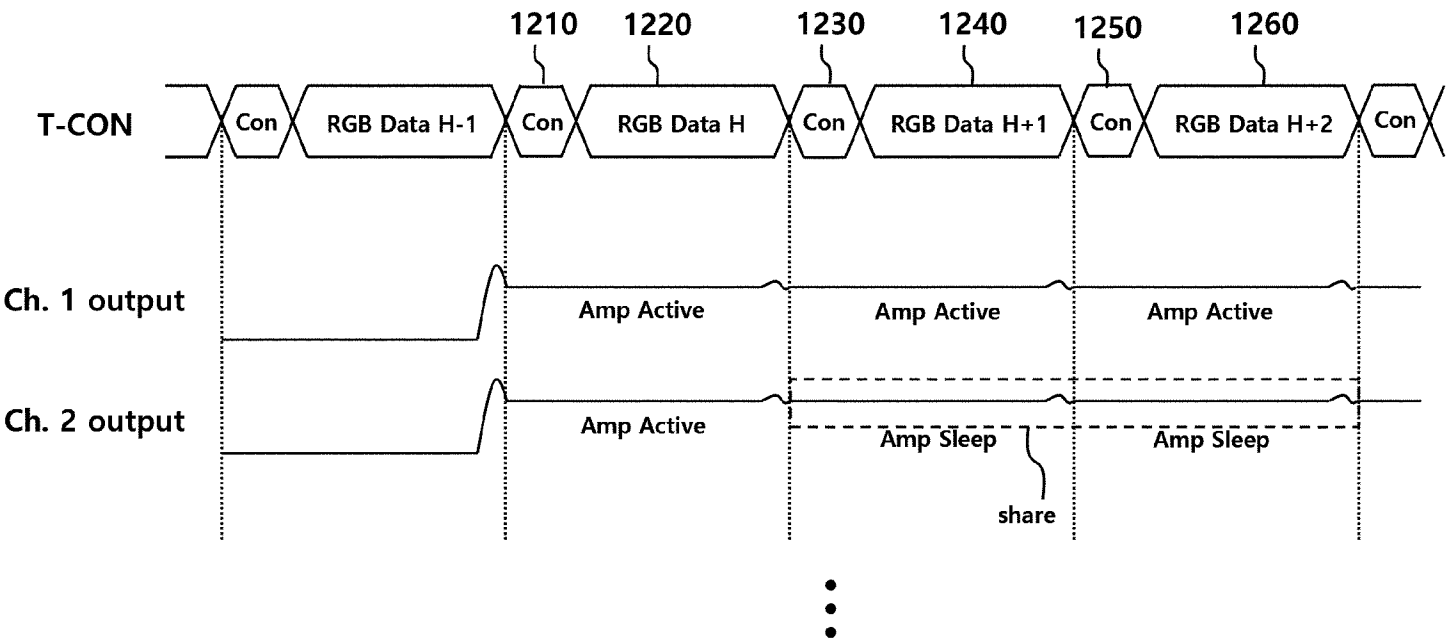
FIG. 12 illustrates the operation in which the data-driving device selectively deactivates channel amplifiers according to another embodiment.

For example, the drive controlling circuit 1122 may activate (Amp Active) all of the channel amplifier of Ch.1, the channel amplifier of Ch.2, and the like corresponding to a plurality of channel amplifiers for the data of the horizontal line H according to amplifier configuration data 1210 received before data 1220 of the horizontal line H in FIG. 12.

Thereafter, the drive controlling circuit 1220 may deactivate (Amp Sleep) one or more channel amplifiers (channel amplifier of the second channel and the like) among two or more channel amplifiers included in a plurality of channel amplifiers among data 1240 of the horizontal line H+1 according to amplifier configuration data 1230 received after the data 1220 of the horizontal line H.

The drive controlling circuit 1122 may control data voltages of channel amplifiers (channel amplifier of the first channel and the like) in the active state among two or more channel amplifiers to be shared.

Even when data 1260 of a horizontal line H+2 directly after the data 1240 of the horizontal line H+1 is the same as the data of the horizontal line H+1, the drive controlling circuit 1122 may maintain the operation state according to the amplifier configuration data 1250 received after the data 1240 of the horizontal line H+1.

In an embodiment, the drive controlling circuit 1122 may include a register and store configuration information for controlling a plurality of channel amplifiers in the register. After receiving amplifier configuration data, the drive controlling circuit 1122 may update the existing configuration information stored in the register to configuration information included in the amplifier configuration data. The drive controlling circuit 1122 may perform control to deactivate (Amp Sleep) one or more channel amplifiers among two or more channel amplifiers included in a plurality of channel amplifiers according to updated configuration information during the horizontal driving period for the data 1240 of the horizontal line H+1 and to make data voltages of the remaining channel amplifiers in the active state, among the two or more channel amplifiers, be shared.

What is claimed is:

1. A device for driving data, the device comprising:

a plurality of channel amplifiers, each arranged in a channel; and a controlling circuit configured to:

sequentially receive amplifier configuration data and image data for a horizontal line H+1 (H being a natural number) from a data processing device through a first signal line connected with the data processing device, and determine, according to the amplifier configuration data, activation or deactivation of a second channel amplifier, among a first channel amplifier for outputting a data voltage corresponding to pixel data of a first channel and the second channel amplifier for outputting a data voltage corresponding to pixel data of a second channel, which is adjacent to the first channel during a horizontal driving period for the image data of the horizontal line H+1, wherein the amplifier configuration data and the image data for the horizontal line H+1 are sequentially transmitted from the data processing device through the first signal line connected with the data processing device.

2. The device of claim 1, wherein, when the second channel amplifier is determined to be deactivated according to the amplifier configuration data, the controlling circuit is configured to block a bias voltage supplied to the second channel amplifier.

3. The device of claim 1, wherein the amplifier configuration data is generated by the data processing device based on a comparison between image data of a horizontal line H and the image data of the horizontal line H+1.

4. The device of claim 1, wherein the device is configured to:

(i) compare image data for a horizontal line H and the image data for the horizontal line H+1; and (ii) after comparing the image data for the horizontal line H and the image data for the horizontal line H+1, compare pixel data of a first channel with pixel data of a second channel adjacent to the first channel, wherein the pixel data of the first channel and the pixel data of the second channel are included in the image data of horizontal line H+1, and the amplifier configuration data is generated based on the comparison (i) and the comparison (ii).

5. The device of claim 4, wherein as a result of determining that the image data for the horizontal line H and the image data for the horizontal line H+1 are different, omitting the comparison (ii).

6. A system comprising:

a data-processing device configured to:

compare image data for a horizontal line H (H being a natural number) with image data for a horizontal line H+1 among image data of a frame for driving pixels of a panel, compare pixel data of a first channel with pixel data of a second channel, which is adjacent to the first channel, among a plurality of pieces of pixel data included in the image data for the horizontal line H+1, generate amplifier configuration data based on whether the data for the horizontal line H and the data for the horizontal line H+1 are identical, and if the pixel data of the first channel and the pixel data of the second channel are identical, sequentially transmit the amplifier configuration data and the image data for the horizontal line H+1 through a first signal line; and a data-driving device comprising a plurality of channel amplifiers and configured to:

sequentially receive the amplifier configuration data and the image data of the horizontal line H+1 through the first signal line from the data-processing device, according to the amplifier configuration data, determine activation or deactivation of a second channel amplifier, among a first channel amplifier for outputting a data voltage corresponding to the pixel data of the first channel and the second channel amplifier for outputting a data voltage corresponding to the pixel data of the second channel during a horizontal driving period for the data of the horizontal line H+1.

7. The system of claim 6, wherein, when the second channel amplifier is determined to be deactivated according to the amplifier configuration data, the data-driving device is configured to make the data voltage of the first channel amplifier be shared through a data line connected to an output side of the second channel amplifier.

8. The system of claim 6, wherein a half of the plurality of channel amplifiers are positive polarity channel amplifiers and the other half are negative polarity channel amplifiers and, if the first channel amplifier is a positive polarity channel amplifier, the second channel amplifier is a positive polarity channel amplifier adjacent to the first channel amplifier.

9. The system of claim 6, wherein, when the image data of the horizontal line H is different from the image data of the horizontal line H−1, the data-driving device is configured to activate all of the plurality of channel amplifiers during a horizontal driving period for the image data for the horizontal line H.

10. A data-processing device comprising:

a receiving circuit configured to receive image data for one frame from an external element;

a controlling circuit configured to:

compare image data for a horizontal line H (H being a natural number) with image data for a horizontal line H+1 among image data for the one frame, compare pixel data of a first channel with pixel data of a second channel, which is adjacent to the first channel, among a plurality of pieces of pixel data included in the image data for the horizontal line H+1, and generate amplifier configuration data including first configuration information in order to activate, among a plurality of channel amplifiers comprised in a data-driving device, a first channel amplifier for outputting a data voltage corresponding to the pixel data of the first channel, and to deactivate or activate a second channel amplifier for outputting a data voltage corresponding to the pixel data of the second channel based on whether the image data for the horizontal line H and the image data for the horizontal line H+1 are identical and if the pixel data of the first channel and the pixel data of the second channel are identical; and a transmitting circuit configured to sequentially transmit the amplifier configuration data and the image data for the horizontal line H+1 to the data-driving device through a first signal line.

11. The data-processing device of claim 10, wherein, when the first configuration information is to deactivate the second channel amplifier, the amplifier configuration data further comprises second configuration information in order for the data-driving device to make the first channel and the second channel share the data voltage of the first channel amplifier.

12. The data-processing device of claim 10, wherein the first configuration information is a register value stored in a register comprised in the data-driving device.

* * * * *